United States Patent [19]

Alexander

[11] 4,378,299

[45] Mar. 29, 1983

[54] CABLE LUBRICATING COMPOSITION AND METHOD

[75] Inventor: William Alexander, Naperville, Ill.

[73] Assignee: American Colloid Company, Skokie, Ill.

[21] Appl. No.: 342,387

[22] Filed: Jan. 25, 1982

[51] Int. Cl.[3] ..... C10M 3/04

[52] U.S. Cl. ..... 252/49.3; 252/51.5 A; 252/52 R; 72/42

[58] Field of Search ..... 252/49.3, 52 R, 14, 252/51.5 A; 72/42

[56] References Cited

U.S. PATENT DOCUMENTS 3,346,495 10/1967 Malec et al. ..... 252/49.3

4,045,362 8/1977 Kuan et al. ..... 252/49.3

4,111,820 9/1978 Conti ..... 252/52 A

*Primary Examiner*—Jacqueline V. Howard

*Attorney, Agent, or Firm*—Mason, Kolehmainen, Rathburn & Wyss

[57] ABSTRACT

A water soluble cable lubricating composition and method involves a lubricant in liquid or gel form that possesses the ability to adhere to the surface to be lubricated. The composition includes an aqueous solution of from about 1 to 4% of a water soluble cellulose derivative, such as carboxymethyl cellulose, and from about ½ to 2% of polyacrylamide. The lubricant may also include a hygroscopic agent such as ethylene glycol to prevent the lubricant from drying out too rapidly in use.

17 Claims, No Drawings

CABLE LUBRICATING COMPOSITION AND METHOD

BACKGROUND OF THE INVENTION

1. Field of the Invention

This invention relates generally to cable lubricants and lubricating methods.

2. Brief Description of the Background Art

It is often necessary to pull a metal cable or wire, or a cable protected by a plastic sheathing through a plastic or metallic or other smooth surfaced duct, tube, or housing. Despite the fact that the cable and the housing through which the cable is to be pulled both have relatively smooth contacting surfaces and thus relatively low coefficients of sliding friction, it is often necessary to provide a cable lubricant to facilitate the pulling of the wire or cable, especially when the housing conforms tightly to the cable or where long lengths of cable are involved. For ease of application it is preferable that the lubricant be in a liquid or colloidal, i.e. gell state. However, the nature of the lubricated surfaces, particularly their smoothness, often results in very low adhesion between the lubricant and the lubricated surface resulting in ineffective lubrication. Moreover, since it is often necessary that the wire or cable pulling operations be conducted over extended periods of time and under various temperature conditions it is preferable that the cable lubricant has good stability both over time and over a wide range of environmental conditions.

In the past, a variety of lubricants have been utilized for facilitating cable pulling and wire drawing including thixotropic paraffin-based gells, and polyethylene oxide gell-like semi-liquid coatings. Polyethylene oxide lubricants for cables are disclosed in U.S. Pat. Nos. 3,925,216 and 4,111,820. The lubricants disclosed in these two patents are water soluble and applied in a liquid state. However, U.S. Pat. No. 3,925,216 possesses inferior friction reducing properties as compared to a thixotropic gell and rapidly evaporates so that little lubricant, if any, remains on the cable or wire after a pulling operation is completed. U.S. Pat. No. 4,111,820 overcomes the disadvantages of the prior art by using a dispersing agent to increase the viscoelasticity and lubricity of the solution. While these synthetic polymeric lubricants have considerable lubricating properties, they suffer from the disadvantage that they have low adherence to the surfaces being lubricated.

SUMMARY OF THE INVENTION

It is a primary object of the present invention to provide a cable lubricant with good lubricating properties which also possesses the ability to strongly adhere to the lubricated surfaces.

Another object of the present invention to provide such a lubricant which resists too rapid drying when exposed in use to the atmosphere.

It is still another object of the present invention to provide such a lubricant which has stability over a range of operating temperatures.

It is yet another object of the present invention to provide a cable lubricating method that results in improved lubrication.

These and other objects of the present invention are achieved by a cable lubricant including from about 1 to about 4% by weight of a water soluble cellulose derivative. A particularly advantageous cellulose derivative is carboxymethyl cellulose forming about 2% by weight of the composition. The lubricant also includes from about ½ to about 2% by weight of polyacrylamide. A particularly advantageous polyacrylamide is a flocculating cationic polymer based on the copolymerization of acrylamide and a cationic derivative of acrylic acid. The cellulose derivative and the polyacrylamide are combined with about 75 to 98.5% water. To achieve the full advantage of the present invention, a hygroscopic agent such as ethylene glycol makes up about 1 to 15% of the lubricant to prevent the composition from drying too rapidly.

DESCRIPTION OF THE PREFERRED EMBODIMENT

A cable lubricant useful for facilitating pulling cables and wires and drawing wire includes the combination of a water soluble cellulose derivative and polyacrylamide in an aqueous solution or gell. The aqueous solution of the cellulose derivative and polyacrylamide is preferably combined with a hygroscopic agent to prevent the drying of the lubricant when applied as a liquid or colloidal film or gell in use.

To achieve the full advantage of the present invention, the polyacrylamide is a water soluble film forming polymer that has a molecular weight of from about 100,000 to about 8 million and preferably about 5 million to 8 million or more. In general, the higher the molecular weight of the polyacrylamide the better. Any copolymer which contains acrylamide is suitable for use herein including, for example, copolymers with acrylic acid esters, acrylic acids, optionally in the form of their salts, and the like. One preferred polyacrylamide for use in the present invention is a cationic polymer which is an organic synthetic flocculating agent, for example, a polymer based on the copolymerization of acrylamide and a cationic derivative of acrylic acid, for example, dimethylaminoethylacrylate and tertiary butylaminoethylacrylate. A suitable polymer of this type is available from Stockhausen Incorporated of Greensboro, N.C. under the trade name PRAESTOL and a particularly suitable polymer of this type is marketed by the above named company using the grade designation 411K. To achieve the full advantage of the present invention, the polyacrylamide polymer has a pH measured in a 1% solution of about 4±.5. The solution viscosity in tap water of a 1% solution is conveniently about 3,000 approximate Brookfield value in centipoise at 20° C. and 5 rpm.

The polyacrylamide enables the lubricant to adhere to the lubricated surfaces ensuring that the lubricant is available on a continuous basis at the points of highest frictional contact. To achieve the full advantage of the present invention, the polyacrylamide is included in the lubricant composition in an amount of about ½ to about 2% by weight of the lubricant composition and preferably about 1% by weight of the lubricant. In ranges significantly above 2%, the polyacrylamide becomes too sticky for use as a lubricant. Below about ½% by weight, the composition does not provide sufficient lubricity making pulling cable or wire through a housing or conduit extremely difficult.

Suitable polyacrylamide polymers are available in free flowing granular solid form but must be thoroughly wetted to ensure that no lumps form in use. The most convenient method to prepare the polymer in a lab is to initially prepare a stock solution of a concentration of about 1%. This is done by rapidly stirring distilled or deionized water at a temperature below 100° F. using a magnetic or mechanical stirrer. The polymer in solid form is sprinkled into the vortex and is mixed continuously at a moderate speed for 45 to 60 minutes to obtain a complete solution. After preparation, the stock solution has a shelf life of about 3 to 4 days.

The water soluble cellulose derivative may be chosen from among the alkyl celluloses including, for example, methyl cellulose, hydroxyethyl cellulose and hydroxypropyl cellulose. However, the preferred water soluble cellulose derivative is carboxymethyl cellulose. Carboxymethyl cellulose is a hydrophilic film former which forms a gell when mixed with water, and possesses good lubricating properties. To achieve the full advantage of the present invention, the water soluble cellulose derivative forms a gell with water and is included in the lubricant composition in an amount from about 1% to about 4% by weight of the total lubricant. In operating ranges well above 4%, the carboxymethyl cellulose tends to form solid balls and is not useful as a lubricant.

The water soluble cellulose derivative and polyacrylamide combine in an aqueous solution or gell in a unique fashion to provide a lubricant which possesses combined properties which, though seemingly inconsistent, are possessed by neither of the constituents. That is, the mixture of the water soluble cellulose derivative and polyacrylamide possesses both high lubricity as well as good adherence to the lubricated surface. Since the mixture is water soluble, it may be applied in a liquid, semi-liquid or gell form easily and quickly and may be subsequently removed by simple water washing.

In accordance with one embodiment of the present invention, a hygroscopic agent is added to the lubricant to improve its stability and to inhibit the drying of the lubricant upon application. A particularly effective hygroscopic agent is ethylene glycol which not only serves to prevent water loss but also acts to lower the freezing point of the lubricant and further acts as a bacteriacide. To achieve the full advantage of this embodiment of the present invention, the hygroscopic agent, i.e., ethylene glycol, is included in the lubricant in an amount from about 5% to about 15% by weight of the lubricant and preferably about 10% by weight of the lubricant.

To achieve the full advantage of the present invention, the cable lubricant composition has a composite pH of less than 7. If the lubricant composition has a pH higher than about 7.0, a bactericide can be added to the composition to prevent the growth of bacteria. Additional ethylene glycol, for example, can be added to lower the pH and to provide bacteriacidal activity.

The various constituents of the lubricant can be mixed in a water solution in any desired manner using conventional techniques. Since the composition generally has a semi-liquid or colloidal consistency, it can be applied in a conventional fashion directly to the lubricated surface using conventional liquid application techniques such as washing, brushing or the like.

Although the invention has been disclosed in connection with certain specific embodiments, it will be readily apparent to those skilled in the art that various changes in the composition can be made without departing from the spirit and scope of the invention.

What is claimed and desired to be secured by Letters Patent of the United States is:

1. A cable lubricant comprising from about 1 to about 4% by weight of a water soluble cellulose derivative, from about ½ to about 2% by weight of polyacrylamide and from about 75% to about 98.5% by weight water.

2. The cable lubricant of claim 1 further including a hygroscopic agent forming from about 1 to about 15% by weight of the lubricant.

3. The cable lubricant of claim 2 wherein said hygroscopic agent is ethylene glycol.

4. The cable lubricant of claim 3 wherein said ethylene glycol is approximately 10% by weight of the composite lubricant.

5. The cable lubricant of claim 1 wherein said water soluble cellulose derivative is carboxymethyl cellulose.

6. The cable lubricant of claim 1 wherein said water soluble cellulose derivative makes up about 2% by weight of the entire composition of the lubricant.

7. The cable lubricant of claim 1 wherein the polyacrylamide has a molecular weight of about 5 million to about 8 million.

8. The cable lubricant of claim 1 wherein said polyacrylamide is a cationic flocculating agent.

9. The cable lubricant of claim 8 wherein said polyacrylamide is based on the copolymerization of acrylamide and a cationic derivative of acrylic acid.

10. The cable lubricant of claim 9 wherein said polyacrylamide is approximately 1% by weight of the cable lubricant.

11. The cable lubricant of claim 1 having a pH of less than 7.

12. A cable lubricant comprising from about 1 to about 4% by weight carboxymethyl cellulose, from about ½ to about 2% by weight polyacrylamide, from about 5 to 15% by weight of a hygroscopic agent and about 75 to about 98.5% water.

13. The cable lubricant of claim 12 wherein carboxymethyl cellulose is about 2% by weight of the lubricant and polyacrylamide is about 1% by weight of the composite lubricant.

14. The cable lubricant of claim 12 wherein said hygroscopic agent is ethylene glycol forming approximately 10% by weight of the composite lubricant.

15. The cable lubricant of claim 12 wherein said polyacrylamide is a flocculating agent based on the copolymerization of acrylamide and a cationic derivative of a acrylic acid having a molecular weight of about 5 million or more.

16. A cable lubricating method for lubricating cable preparatory to pulling the cable through a housing, comprising:

preparing an aqueous, colloidal composition of polyacrylamide, carboxymethyl cellulose, and a hygroscopic agent;

applying the composition in a colloidal film to the surface of the cable.

17. The method of claim 16 wherein the step of preparing an aqueous solution includes the steps of adding sufficient carboxymethyl cellulose to form approximately 1% to 4% by weight of the composition, sufficient polyacrylamide to form approximately ½% to 2% by weight of the composition, and sufficient hygroscopic agent to form about 5% to 15% by weight of the solution.

* * * * *